US005778698A

United States Patent [19]

Yamamoto

[11] Patent Number: 5,778,698

[45] Date of Patent: Jul. 14, 1998

[54] ULTRA HIGH PURITY NITROGEN AND OXYGEN GENERATOR UNIT

[75] Inventor: Takao Yamamoto, Hyogo-ken, Japan

[73] Assignee: Teisan Kabushiki Kaisha, Tokyo, Japan

[21] Appl. No.: 755,006

[22] Filed: Nov. 22, 1996

[30] Foreign Application Priority Data

Mar. 27, 1996 [JP] Japan ..... 8-072448

[51] Int. Cl.[6] ..... F25J 3/00

[52] U.S. Cl. ..... 62/652

[58] Field of Search ..... 62/643, 652

[56] References Cited

U.S. PATENT DOCUMENTS 4,617,037 10/1986 Okada et al. ..... 62/652
4,848,996 7/1989 Thorogood et al. ..... 62/652
5,205,127 4/1993 Agrawal ..... 62/652
5,349,822 9/1994 Nagamura et al. ..... 62/652

*Primary Examiner*—Ronald C. Capossela
*Attorney, Agent, or Firm*—Young & Thompson

[57] ABSTRACT

A unit capable of simultaneously producing nitrogen of ultra high purity and liquid oxygen of ultra high purity, is provided. The inside of the first rectification column 6 is demarcated to an upper rectifying part 12, and upper-stage middle rectifying part 13, a lower-stage middle rectifying part 14 and a lower rectifying part 15. To the upper part 11 above the upper rectifying part 12 is connected a nitrogen condenser 8. A second rectification column 7 is demarcated to an upper rectifying part 22 and a lower rectifying part 23, and has a reboiler 25 provided under its lower rectifying part 22. Ultra high purity liquid nitrogen is recovered from between the upper rectifying part 12 and upper-stage middle rectifying part 13 of the first rectification column 6, and ultra high purity liquid oxygen is recovered from below the lower rectifying part 23 of the second rectification column 7.

7 Claims, 3 Drawing Sheets

ULTRA HIGH PURITY NITROGEN AND OXYGEN GENERATOR UNIT

TECHNICAL FIELD

The present invention relates to an ultra high purity nitrogen and oxygen generator unit for simultaneously producing ultra high purity nitrogen and ultra high purity oxygen from air as a feed material by use of rectification columns, and especially to a generator unit for producing ultra high purity nitrogen having an oxygen concentration of 10 ppb or less as an impurity and ultra high purity oxygen having a purity of 99.999995% or more, which can be used in a semiconductor-manufacturing process.

PRIOR ART

FIG. 3 shows a flow sheet of a conventional ultra high purity nitrogen and oxygen generator unit described in the official gazette of Japanese Patent Application Laid-open (KOKAI) No. 296,651/1993. In the drawing, the reference numeral 54 represents a first rectification column, 55 represents a second rectification column, 56 represents a third rectification column, 57 represents a fourth rectification column, 58 represents a nitrogen condenser, 53 represents a main heat exchanger and 59 represents an expansion turbine, respectively.

After feed air is compressed, it is freed of carbon dioxide and moisture, and then cooled down by the main heat exchanger 53, whereby a portion of the feed air is introduced into a lower space part **54*e* of the first rectification column 54 as it is liquefied. The liquid phase portion of the feed air introduced in the lower space part 54*e* collects in the bottom of the lower space part 54*e* and the gas phase portion thereof is caused to rise through the first rectification column 54, i.e. to pass in turn through a lower rectifying part 54*d*, a middle rectifying part 54*c* and an upper rectifying part 54*b* so as to be brought in counter-current contact with a reflux liquid consisting mainly of liquid nitrogen, which flows down from above. Accordingly, oxygen and mainly components (hydrocarbons, krypton, xenon, etc.) having higher boiling points than that of oxygen in the gas phase are absorbed into the reflux liquid, while nitrogen and mainly components (neon, hydrogen, helium, etc.) having lower boiling points than that of nitrogen in the reflux liquid are evaporated and released into the gas phase. As a result, high purity nitrogen gas containing lower boiling point components collects in the upper space part 54*a* and oxygen-rich liquid air containing higher boiling point components collects in the lower space part 54*e***.

The high purity nitrogen gas collected in the upper space part **54*a* is introduced into the nitrogen condenser 58 so as to be cooled down, and the thus condensed high purity liquid nitrogen is supplied to the upper rectifying part 54*b*** as a reflux liquid again, while non-condensed gas in which the lower boiling point components have been concentrated is discharged out of the system.

A portion of the oxygen-rich liquid air collected in the lower space part **54*e* is introduced into an expansion valve 61, where it is reduced in pressure so as to get oxygen-rich waste gas having a low temperature, and this oxygen-rich waste gas will be introduced into the nitrogen condenser 58 as a refrigerant. The oxygen-rich waste gas discharged from the nitrogen condenser 58 is further introduced into the expansion turbine 59, exchanged in heat in the main heat exchanger 53**, and then discharged out of the system.

Liquid nitrogen condensed in the nitrogen condenser 58 and supplied to the upper rectifying part **54*b* is brought in counter-current contact with a rising gas consisting mainly of nitrogen as it is flowing down in the upper rectifying part 54*b*, so as to get ultra high purity liquid nitrogen because the lower boiling point components remaining therein are further released. This ultra high purity liquid nitrogen collects in a reservoir part 54*g* provided between the upper rectifying part 54*b* and the middle rectifying part 54*c*. A portion thereof is extracted out as the ultra high purity liquid nitrogen, reduced in pressure by an expansion valve 63, brought in heat exchange and then supplied to the outside of the system as an ultra high purity nitrogen gas product, and the remaining portion is further caused to flow down through the middle rectifying part 54*c*** as a reflux liquid.

Another portion of the oxygen-rich liquid air collected in the lower space part **54*e* is fed to an expansion valve 62, where it is reduced in pressure and partially evaporated so as to get a gas-liquid mixture, and this gas-liquid mixture is supplied to above the rectifying part 55*b* of the second rectification column 55. The gas phase portion of this gas-liquid mixture collects in the upper space part 55*a*, and the liquid phase portion thereof is caused to flow down through the rectifying part 55*b* as a reflux liquid, where it is brought in counter-current contact with a gas rising from below so as to be enhanced in oxygen concentration, with releasing the lower boiling point components, and collects in the lower space part 55*c*. In the lower space part 55*c* is installed a reboiler 71 for heating liquid collected in the lower space part 55*c* so that components (argon, carbon monoxide, nitrogen, etc.) having lower boiling points than that of oxygen are selectively evaporated together with oxygen, and caused to rise through the rectifying part 55*b*. As a result, liquid oxygen containing higher boiling point components collects in the lower space part 55*c* and gas containing oxygen, nitrogen and lower boiling point components collects in the upper space part 55*a***, and they will be discharged out of the system from the column bottom part and column top part, respectively.

Oxygen gas collected in the gas phase portion above the liquid level of the lower space part **55*c* of the second rectification column 55 is supplied to the lower space part 56*c* of the third rectification column 56. The oxygen gas supplied therein is brought in counter-current contact with a reflux liquid (high purity liquid oxygen) as it is rising through the rectifying part 56*b*, whereby higher boiling point components are absorbed in the reflux liquid and at the same time, a portion of oxygen in the reflux liquid is evaporated. In the upper space part 56*a* of the third rectification column 56 is installed a condenser 81 for cooling down and condensing gas (high purity oxygen) collected in the upper space part 56*a* and supplying the thus-condensed gas to the rectifying part 56*b* as said reflux liquid. And as a result, liquid oxygen containing a trace of higher boiling point components collects in the lower space part 56*c* and high purity oxygen gas containing a trace of lower boiling point components collects in the upper space part 56*a*. The liquid oxygen containing higher boiling point components collected in the lower space part 56*c* is returned to the lower space part 55*c* of the second rectification column 55**.

High purity oxygen gas collected in the upper space part **56*a* is supplied to the middle part 57*c* between the upper rectifying part 57*b* and lower rectifying part 57*d* of the fourth rectification column 56. The high purity oxygen gas supplied therein is brought in counter-current contact with a reflux liquid (high purity liquid oxygen) as it is rising through the upper rectifying part 57*b***, whereby oxygen is absorbed in the reflux liquid and at the same time, lower boiling point components in the reflux liquid are evaporated.

In the upper space part 57*a* of the fourth rectification column 57 is installed a condenser 82 for cooling down and condensing gas (high purity oxygen) collected in the upper space part 57*a* and supplying the thus-condensed gas to the rectifying part 57*b* as said reflux liquid. In the lower space part 57*e*, on the other hand, a reboiler 72 is installed which serves to heat liquid (ultra high purity liquid oxygen collected in the lower space part 57*c* so that components having lower boiling points than that of oxygen are selectively evaporated together with oxygen and the thus-evaporated components are caused to rise in turn through the lower rectifying part 57*d* and upper rectifying part 57*b* so as to be brought in counter-current contact with the reflux liquid (high purity liquid oxygen). And as a result, ultra high purity liquid oxygen collects in the lower space part 57*e* and oxygen gas in which the lower boiling point components have been concentrated collects in the upper space part 57*a*. The oxygen gas collected in the upper space part 57*a* will be discharged out of the system from the column top part, and the ultra high purity liquid oxygen collected in the lower space part 57*e* will be recovered as a product and supplied to the outside of the system.

The official gazette of Japanese Patent Application Laid-open (KOKAI) No. 105,088/1986 describes a method of producing nitrogen gas (99.97%) and ultra high purity oxygen gas (99.998%) by use of two rectification columns. According to this method, feed air is fed to the bottom part of a first rectification column and oxygen-enriched liquid air extracted from a position which is above one equilibrium stage from the lower end of the rectifying part of the first rectification column is fed to the top part of a second rectification column, wherein nitrogen-enriched gas is recovered from the vicinity of the top part of the first rectification column and ultra high purity oxygen gas is recovered from a position which is above one equilibrium state from the lower end of the rectifying part of the second rectification column (see: FIG. 2 of the official gazette).

Although the unit described in the official gazette of Japanese Patent Application Laid-open (KOKAI) No. 296,651/1993 possesses an advantage that nitrogen of ultra high purity and oxygen of ultra high purity can be produced from one unit only by the liquefaction and rectification of feed air, there are such defects that four rectification columns are required, a piping system is complicated and the operation condition is complicated because of plural condensers and reboilers installed. The method described in the official gazette of Japanese Patent Application Laid-open (KOKAI) No. 105,088/1986 is not one of obtaining ultra high purity nitrogen at the same time.

Due to consideration of the aforementioned problems, the present invention is intended to provide a generator unit capable of simultaneously producing ultra high purity nitrogen and ultra high purity oxygen by use of a simple unit, in which the rate of the amounts of ultra high purity nitrogen and ultra high purity oxygen to be produced can be changed only by one valve operation.

SUMMARY OF THE INVENTION

An ultra high purity nitrogen and oxygen generator unit according to the present invention comprises:

- a first rectification column having, in order from above, a first upper space part, an upper rectifying part, an upper-stage middle rectifying part, a lower-stage middle rectifying part, a lower rectifying part and a first lower space part;
- a second rectification column having a second upper space part, an upper rectifying part, a lower rectifying part and a second lower space part;
- a main heat exchanger for cooling down air as a feed material through an indirect heat exchange with a refrigerant, and supplying the thus-cooled air to below said lower rectifying part;
- a high purity liquid nitrogen supply pipe for supplying high purity liquid nitrogen for replenishment of cold (also as a reflux liquid) to above said upper rectifying part;
- a nitrogen condenser for cooling down high purity nitrogen gas collected in the first upper space part, which is introduced therein, and supplying the thus-condensed high purity liquid nitrogen to above the upper rectifying part as a reflux liquid and discharging the non-condensed gas out of the system;
- a first expansion valve for reducing the pressure of oxygen-rich liquid air collected in the first lower space part, which is introduced therein, and supplying the thus-generated oxygen-rich waste gas to the nitrogen condenser as a refrigerant;
- an oxygen-rich waste gas pipe for supplying the oxygen-rich waste gas which has been used as a refrigerant in the nitrogen condenser and then discharged therefrom to said main heat exchanger as a refrigerant;
- an ultra high purity nitrogen delivery pipe for recovering a portion of the reflux liquid from between the upper rectifying part and the upper-stage middle rectifying part as ultra high purity liquid nitrogen;
- a second expansion valve for reducing the pressure of a portion of the reflux liquid which is introduced therein from between the upper-stage middle rectifying part and the lower-stage middle rectifying part, and supplying the thus-generated gas-liquid mixture to above the upper rectifying part of the second rectification column;
- a reboiler placed in the second lower space part for heating liquid collected in the second lower space part to evaporate a portion thereof;
- a pipe for extracting air from between the lower-stage middle rectifying part and the lower rectifying part, and supplying the thus-extracted air to the reboiler as a heating source;
- a pipe having a fourth expansion valve for supplying air which has been used as the heating source in the reboiler so as to be cooled down and liquefied as itself to above the lower rectifying part;
- a waste gas discharge pipe for discharging gas collected in the second upper space part out of the system; and
- an ultra high purity oxygen delivery pipe for recovering liquid collected in the second lower space part as ultra high purity liquid oxygen.

A process for simultaneously producing nitrogen of ultra high purity and oxygen of ultra high purity by use of this unit, will be described here.

Feed air cooled down through an indirect heat exchange with a refrigerant in the main heat exchanger is supplied to below the lower rectifying part of the first rectification column. On the other hand, high purity liquid nitrogen to be used for replenishment of cold (also as a reflux liquid) is supplied to above the upper rectifying part of the first rectification column through the high purity liquid nitrogen supply pipe from the outside of the system.

The feed air supplied therein is caused to rise through the first rectification column, i.e. to pass in turn through the lower rectifying part, the lower-stage middle rectifying part, the upper-stage middle rectifying part and the upper rectifying part so as be brought in counter-current contact with a reflux liquid consisting mainly of liquid nitrogen, which flows down from above. Accordingly, oxygen and mainly components (hydrocarbons, krypton, xenon, etc.) having higher boiling points than that of oxygen in the gas phase are absorbed into the reflux liquid, while nitrogen and mainly components (neon, hydrogen, helium, etc.) having lower boiling points than that of nitrogen in the reflux liquid are evaporated and released into the gas phase. As a result, high purity nitrogen gas containing lower boiling point components collects in the first upper space part and oxygen-rich liquid air containing higher boiling point components collects in the first lower space part.

The high purity nitrogen gas collected in the first upper space part is introduced into the nitrogen condenser so as to be cooled down, and the thus-condensed high purity liquid nitrogen is supplied to above the upper rectifying part as a reflux liquid again, while non-condensed gas in which the lower boiling point components have been concentrated is discharged out of the system.

The oxygen-rich liquid air collected in the first lower space part is introduced into a first expansion valve, where it is reduced in pressure so as to get oxygen-rich waste gas having a low temperature, and this oxygen-rich waste gas will be introduced into the nitrogen condenser as a refrigerant. The oxygen-rich waste gas used as a refrigerant in the nitrogen condenser is further reduced in pressure and then supplied to the main head exchanger through the oxygen-rich waste gas pipe, where it is used as a refrigerant for cooling down the feed air and then discharged out of the system.

The high purity liquid nitrogen supplied to above the upper rectifying part as a reflux liquid and the high purity liquid nitrogen condensed in the nitrogen condenser are brought in counter-current contact with a rising gas consisting mainly of nitrogen so as to further release the lower boiling point components remaining therein as they flow down through the upper rectifying part. Then, they enter into between the upper rectifying part and upper-stage middle rectifying part. Now, a portion of them is recovered as a product of ultra high purity liquid nitrogen through the ultra high purity nitrogen delivery pipe, and the remaining portion thereof is caused to flow down as a reflux liquid through the upper-stage middle rectifying part. A portion of the reflux liquid is extracted out further from between the upper-stage middle rectifying part and lower-stage middle rectifying part and introduced into a second expansion valve, and the remaining portion thereof flows down through the lower-stage middle rectifying part and lower rectifying part to absorb higher boiling point components in the feed air and then collects in the first lower space part.

The reflux liquid introduced in the second expansion valve which has got liquid air free of higher boiling point components is reduced in pressure and partially evaporated by the second expansion valve so as to get a gas-liquid mixture, and then supplied to above the upper rectifying part of the second rectification column. The gas phase portion of this gas-liquid mixture collects in the upper space part, and the liquid phase portion thereof flows down as a reflux liquid through the rectifying part so as to release lower boiling point components and to enhance the concentration of oxygen through counter-current contact with a gas rising from below, and then collects in the lower space part. In the lower space part is installed a reboiler for heating liquid collected in the lower space part so that components (argon, carbon monoxide, nitrogen, etc.) having lower boiling points than that of oxygen are selectively evaporated together with oxygen and the thus-evaporated components are caused to rise through the rectifying part. And as a result, nitrogen gas containing components having lower boiling points than that of oxygen collects in the upper space part and it is discharged out of the system from the top part through the waste gas pipe, and ultra high purity liquid oxygen collects in the lower space part and it is recovered as a product through the ultra high purity oxygen delivery pipe.

In the aforementioned unit, cold of the high purity liquid nitrogen (reflux liquid) introduced therein from the outside of the system through the high purity liquid nitrogen supply pipe is utilized as a cold source necessary for the operation of the unit. In place of this cold source, however, it is also possible to generate cold within the system. In this case, an expansion turbine is installed, and the oxygen-rich waste gas used as a refrigerant in the nitrogen condenser and then discharged therefrom is reduced in pressure by this expansion turbine so that its temperature is caused to drop, and it is then supplied to said main heat exchanger as a refrigerant for cooling down the feed air.

By installation of a third expansion valve, cold of the ultra high purity liquid nitrogen can be also recovered. In this case, the ultra high purity liquid nitrogen is introduced into this third expansion valve through said ultra high purity nitrogen delivery pipe so as to be reduced in pressure, and the thus-generated ultra high purity nitrogen gas having a low temperature in a gas-liquid mixed state is used as a portion of the refrigerant in said nitrogen condenser and then supplied to the outside of the system as a product.

As a warming source for the reboiler installed in the second lower space part of the second rectification column, in addition, the feed air can be utilized. In this case, a portion of the feed air is introduced as a warming source into the reboiler from between the lower-stage middle rectifying part and the lower rectifying part, and the cooled and condensed feed air is then returned to between the upper rectifying part and lower rectifying part of said second rectification column after it is reduced in pressure by a fourth expansion valve.

Furthermore, in order to regulate the amount of the reflux liquid flowing through the lower rectifying part of the first rectification column, a flow rate regulation valve is installed. By way of this flow rate regulation valve, a portion of the reflux liquid is extracted out from between the lower-stage middle rectifying part and lower rectifying part and directly introduced into the first lower space part. By regulation of the amount of the reflux liquid flowing through the lower rectifying part, the concentration of oxygen in the liquid air to be introduced into the second rectification column can be regulated.

EMBODIMENTS OF THE INVENTION

FIG. 1 shows a flow sheet of one example of the ultra high purity nitrogen and oxygen generator unit based on the present invention. In the drawing, the reference numeral 5 represents a main heat exchanger, 6 represents a first rectification column, 7 represents a second rectification column, 8 represents a nitrogen condenser, 11 represents a first upper space part, 12 represents an upper rectifying part, 13 represents an upper-stage middle rectifying part, 14 represents a lower-stage middle rectifying part, 15 represents a lower rectifying part, 16 represents a first lower space part, 21 represents a second upper space part, 22 represents an upper rectifying part, 23 represents a lower rectifying part, 24 represents a second lower space part, 25 represents a reboiler, 31 represents a first expansion valve, 32 represents a second expansion valve, 33 represents a third expansion valve, 34 represents a fourth expansion valve, 35 represents a fifth expansion valve, 40 represents an insulated box, 60 represents a flow rate regulation valve, 100 represents a high purity liquid nitrogen supply pipe, 109 represents an ultra high purity nitrogen delivery pipe, 110 represents an ultra high purity liquid oxygen delivery pipe, 117 represents an oxygen-rich waste gas pipe and 118 represents a waste gas pipe, respectively.

The first rectification column 6 has, in turn from above, the first upper space part 11, the upper rectifying part 12, the upper-stage middle rectifying part 13, the lower-stage middle rectifying part 14, the lower rectifying part 15 and the first lower space part 16, and further has an upper reservoir part 17 for reservoiring a reflux liquid above the upper rectifying part 12, an upper-stage middle reservoir part 18 for reservoiring a reflux liquid between the upper rectifying part 12 and upper-stage middle rectifying part 13, a lower-stage middle reservoir part 19 for reservoiring a reflux liquid between the upper-stage middle rectifying part 13 and lower-stage middle rectifying part 14, a lower reservoir part 20 for reservoiring a reflux liquid between the lower-stage middle rectifying part 14 and lower rectifying part 15, and the flow rate regulation valve 60 for directly introducing a portion of the reflux liquid from said lower reservoir part 20 into the lower space part 16 to regulate the amount of the reflux liquid flowing through the lower rectifying part 15. The second rectification column 7 has the second upper space part 21, the upper rectifying part 22, the lower rectifying part 23 and the second lower space part 24. A route of feed air in the main heat exchanger 5 ie connected to the first lower space part 16 by means of a pipe 105. To the upper reservoir part 17 is connected the high purity liquid nitrogen supply pipe 100 for supplying high purity liquid nitrogen for replenishment of cold (also as a reflux liquid) from the outside of the system.

The introduction side of the nitrogen condenser 8 is connected to the top of the first upper space part 11 by means of a pipe 106 and the discharge side thereof is connected to the upper reservoir part 17 by way of a pipe 107 and the high purity liquid nitrogen supply pipe 100. To the discharge side of the nitrogen condenser 8 is further connected a pipe 119 for discharging non-condensed gas out of the system by way of a gas-liquid separator (not shown). The first refrigerant supply side of the nitrogen condenser 8 is connected to the bottom of the first lower space part 16 by means of a pipe 108, and said pipe 108 has the first expansion valve 31 provided on its way. The first refrigerant discharge side of the nitrogen condenser 8 is connected to the main heat exchanger 5 by means of the oxygen-rich waste gas pipe 117 having the fifth expansion valve 35. The second refrigerant supply side of the nitrogen condenser 8 is connected to the upper-stage middle reservoir part 18 by means of the ultra high purity nitrogen delivery pipe 109, and said ultra high purity nitrogen delivery pipe 109 has the third expansion valve 33 provided on its way. The second refrigerant discharge side of the nitrogen condenser 8 is connected to the main heat exchanger 5 by means of a pipe 111.

The lower-stage middle reservoir part 19 is connected to above the rectifying part 22 of the second rectification column 7 by means of a pipe 114, and said pipe 114 has the second expansion valve 32 provided on its way. In the second lower space part 24 is installed the reboiler 25. The thermal medium supply side of said reboiler 25 is connected to a space part between the lower-stage middle rectifying part 14 and the lower rectifying part 15 by means of a pipe 115, and the thermal medium discharge side thereof is connected to the second middle space part 26 by means of a pipe 116. The top part of the second upper space part 21 is connected to the way of the oxygen-rich waste gas pipe 117 through the waste gas pipe 118. To the second lower space part 24 is connected the ultra high purity liquid oxygen delivery pipe 110.

In addition, the first rectification column 6, second rectification column 7, nitrogen condenser 8, main heat exchanger 5 and pipes and valves attached thereto are accommodated in the insulated box 40.

A process for producing nitrogen of ultra high purity and oxygen of ultra high purity by use of this unit will be described here.

After feed air is freed of dust by a filter (not shown), it is compressed to a pressure of about 8.4 kg/cm2 G by a compressor 1. In succession, hydrogen, carbon monoxide and hydrocarbons contained in the feed air are oxidized in a carbon monoxide/hydrogen converter 2 filled with an oxidation catalyst, the feed air is cooled down by a refrigerator 3, and carbon dioxide and moisture are then removed from the feed air by a de-carbonating/drying unit **4*a* or 4*b*. Thereafter, the feed air is cooled down to a temperature of about −167° C. through indirect head exchange with a refrigerant in the main heat exchanger 5, and supplied to below the lower rectifying part 15 of the first rectification column 6 through a pipe 105 as it is partially liquefied. On the other hand, the high purity liquid nitrogen which will be used for replenishment of cold (also as a reflux liquid) is supplied from the outside of the system to the upper reservoir part 17 provided above the upper rectifying part 12 of the first rectification column 6 through the high purity liquid nitrogen supply pipe 100**.

The liquid phase portion of the feed air supplied in the first rectification column 6 collects in the bottom of the first lower space part 16, and the gas phase portion thereof is caused to rise through the first rectification column 6, i.e. to pass in turn through the lower rectifying part 15, lower-stage middle rectifying part 14, upper-stage middle rectifying part 13 and upper rectifying part 12 so as to be brought in counter-current contact with a reflux liquid consisting mainly of liquid nitrogen, which flows down from above. Accordingly, oxygen and mainly components (methane, krypton, xenon, etc.) having higher boiling points than that of oxygen in the gas phase are dissolved into the reflux liquid, while nitrogen and components (neon, hydrogen, helium, etc.) having lower boiling points than that of nitrogen in the reflux liquid are evaporated and released into the gas phase. As a result, high purity nitrogen gas containing lower boiling point components collects in the first upper space part 11 and oxygen-rich liquid air containing higher boiling point components collects in the first lower space part 16.

All amount of the high purity nitrogen gas containing lower boiling point components, collected in the first upper space part 11, is introduced into the nitrogen condenser 8 through a pipe 106 so as to be cooled down through indirect head exchange with a refrigerant, and the thus-condensed high purity liquid nitrogen is returned to the upper reservoir part 17 above the upper rectifying part 12 as a reflux liquid through a pipe 107 and the high purity liquid nitrogen supply pipe 100, while the non-condensed gas in which the lower boiling point components have been concentrated is discharged out of the system through a pipe 119.

A portion of the oxygen-rich liquid air having a temperature of about −168° C., collected in the bottom of the first lower space part 16, is introduced into the first expansion valve 31 through a pipe 108, where it is reduced in pressure to a pressure of about 3 kg/cm2G and supplied to the nitrogen condenser 8 as a refrigerant. Oxygen-rich waste gas having a temperature of about −175° C., used here, is further reduced in pressure to a pressure of about 0.3 kg/cm2G at the expansion valve 35, and introduced into the main heat exchanger 5 through the oxygen-rich waste gas pipe 117, where it is used as a refrigerant to cool down the feed air. After the oxygen-rich waste gas is further used as a regeneration gas for the de-carbonating/drying unit 4*a* or 4*b*, it is discharged out of the system.

The high purity liquid nitrogen supplied to the upper reservoir part 17 above the upper rectifying part 12 and the high purity liquid nitrogen condensed in the nitrogen condenser 8 are brought in counter-current contact with a rising gas consisting mainly of nitrogen so as to get ultra high purity liquid nitrogen, with further releasing the lower boiling point components remaining therein, as they flow down through the upper rectifying part 12, and this ultra high purity liquid nitrogen collects in the upper reservoir part 18 provided between the upper rectifying part 12 and upper-stage middle rectifying part 13. Now, a portion of the ultra high purity liquid nitrogen is extracted out from the upper reservoir part 18 through the ultra high purity nitrogen delivery pipe 109 and introduced into the third expansion valve 33, and the remaining portion thereof is caused to further flow down as a reflux liquid through the upper-stage middle rectifying part 13. The ultra high purity liquid nitrogen introduced in the third expansion valve 33 is reduced in pressure so as to get ultra high purity nitrogen gas having a pressure of about 6.8 kg/cm2G and a temperature of about −173° C., in a gas-liquid mixed state, and this ultra high purity nitrogen gas is supplied to the nitrogen condenser 8 as a portion of said refrigerant. The ultra high purity nitrogen gas taken out of the nitrogen condenser 8 is further indroduced into the main heat exchanger 5 through a pipe 111, where it is used as a portion of the refrigerant to cool down the feed air and then supplied to the outside of the system as an ultra high purity nitrogen gas product by way of a pipe 113.

A portion of the reflux liquid collected in the lower-stage middle reservoir part 19 provided between the upper-stage middle rectifying part 13 and lower-stage middle rectifying part 14, which has got liquid air free of higher boiling point components, further flows down through the lower rectifying part 14 to absorb higher boiling point components in the feed air and then collects in the first lower space part 16, and the other portion thereof is extracted out through a pipe 114 and introduced into the second expansion valve 32. The reflux liquid introduced in the second expansion valve 32 is reduced in pressure to a pressure of about 0.3 kg/cm2G and partially evaporated so as to get a gas-liquid mixture having a temperature of about −190° C., and this gas-liquid mixture is supplied to above the upper rectifying part 22 of the second rectification column 7. The gas phase portion of this gas-liquid mixture collects in the second upper space part 21 and the liquid phase thereof flows down as a reflux liquid through the upper rectifying part 22 so as to release lower boiling point components and to enhance the concentration of oxygen through counter-current contact with a gas rising from below, and then collects in the second lower space part 24. In the second lower space part 24 is installed the reboiler 25, where the feed air free of higher boiling point components such as methane is introduced therein as a warming source from between the first lower-stage middle rectifying part 14 and first lower rectifying part 15 through a pipe 115 to heat the liquid collected in the second lower space part 24 so that components (argon, carbon monoxide, nitrogen, etc.) having lower boiling points than that of oxygen are selectively evaporated together with oxygen and the thus-evaporated components are caused to rise through the lower rectifying part 23 and upper rectifying part 22. In addition, the feed air which has been used as a warming source in the reboiler 25 is condensed and extracted out by means of a pipe 116, and then led into the fourth expansion valve 34, where it is reduced in pressure to a pressure of about 0.3 kg/cm G, and introduced into between the upper rectifying part 22 and lower rectifying part 23.

As a result, nitrogen gas containing components having lower boiling points than that of oxygen collects in the second upper space part 21, and ultra high purity liquid oxygen collects in the second lower space part 24. The nitrogen gas collected in the second upper space part 21 is caused to joint with the oxygen-rich waste gas pipe 117 through the waste gas pipe 118 from the top part, and then introduced into the main heat exchanger 5 as a refrigerant, while the ultra high purity liquid oxygen collected in the second lower space part 24 is recovered as a product through the ultra high purity oxygen delivery pipe 110.

FIG. 2 shows a flow sheet of another example of the ultra high purity nitrogen and oxygen generator unit based on the present invention. In the drawing, the reference numeral 50 represents an expansion turbine. In this example, the inlet side of the expansion turbine 50 is connected to an oxygen-rich waste gas take-out port provided on the way of the main heat exchanger 5 through a pipe 121, and the outlet side of the expansion turbine 50 is connected to the refrigerant introduction port of the main heat exchanger 5 through a pipe 122. In addition, this unit has no pipe (which corresponds to the pipe 100 in FIG. 1) for supplying high purity liquid nitrogen from the outside of the system to the first rectification column as a cold source (also as a reflux liquid) and the waste gas pipe 118 joins with the pipe 122. Except for these points, the unit of this example has the same construction as the unit described in FIG. 1.

A portion of the oxygen-rich liquid air having a temperature of about −168° C., collected in the bottom of the first lower space part 16, is introduced into the first expansion valve 31 through a pipe 108, where it is reduced in pressure to a pressure of about 3.2 kg/cm2G and then supplied to the nitrogen condenser 8 as a refrigerant. After the oxygen-rich waste gas used here is introduced into the main heat exchanger 5 at a temperature of about −175° C. through the oxygen-rich waste gas pipe 117, it is taken out at a temperature of about −150° C. from the way of the main heat exchanger 5 and introduced into the the expansion turbine 50 through a pipe 121. The oxygen-rich waste gas which has been reduced in pressure to a pressure of about 0.3 kg/cm2G and caused to drop in temperature to a temperature of about −180° C. by means of the expansion turbine 50, is again introduced into the main heat exchanger 5 through a pipe 122 so as to be used for cooling down the feed air. By virtue of the installation of the expansion turbine 50, it becomes possible to provide, in the system, cold necessary for operation of the unit, and hence there is no need of supplying high purity liquid nitrogen for replenishment of cold (also as a reflux liquid) from the outside of the system.

By directly introducing a portion of the reflux liquid extracted from the lower reservoir part 20 between the lower-stage middle rectifying part 14 and lower rectifying part 15 by way of the flow rate regulation valve 60 into the first lower space part 16, the amount of the reflux liquid flowing through the lower rectifying part 15 can be regulated, and as a result, the feed air to be introduced into the second rectification column 7 through the pipe 115 does not contain higher boiling point components such as methane, and at the same time, the amount of the ultra high purity liquid oxygen as a product can be regulated by adjusting the concentration of oxygen.

In the unit based on the present invention, the inner rectifying part of the first rectification column is divided to four stages, wherein liquid nitrogen of ultra high purity is recovered from between the upper rectifying part and upper-stage middle rectifying part. Liquid air free of higher boiling point components, recovered from between the upper-stage middle rectifying part and lower-stage middle rectifying part, is reduced in pressure by the expansion valve, and then supplied to above the rectifying part of the second rectification column, and gaseous air free of higher boiling point components, recovered from between the lower-stage middle rectifying part and lower rectifying part of the first rectification column, is introduced into the reboiler of the second rectification column while its pressure is not changed, where it is used as a heating source for the reboiler, whereby oxygen and components having lower boiling points than that of oxygen in the ultra high purity liquid oxygen reservoired in the bottom of the second rectification column are evaporated and brought into countercurrent gas-liquid contact with the reflux liquid in the rectifying part of the second rectification column to separate the lower boiling point components. After the gaseous air used as the heating source for the reboiler is cooled down and liquefied, led out therefrom and reduced in pressure by means of the expansion valve, it is introduced into between the upper rectifying part and lower rectifying part of the second rectification column to increase the amounts of the feed material for the ultra high purity liquid oxygen produced in the second rectification column and the reflux liquid. By changing the amount of the reflux liquid flowing down through the lower rectifying part of the first rectification column by means of the flow rate regulation valve installed with the same lower rectifying part held therebetween, the rate of ultra high purity liquid nitrogen to oxygen can be changed. Owing to the aforementioned construction, nitrogen gas of ultra high purity and liquid oxygen of ultra high purity can be simultaneously produced, with a good efficiency, by a relatively simple unit comprising two rectification columns.

Figure 1:
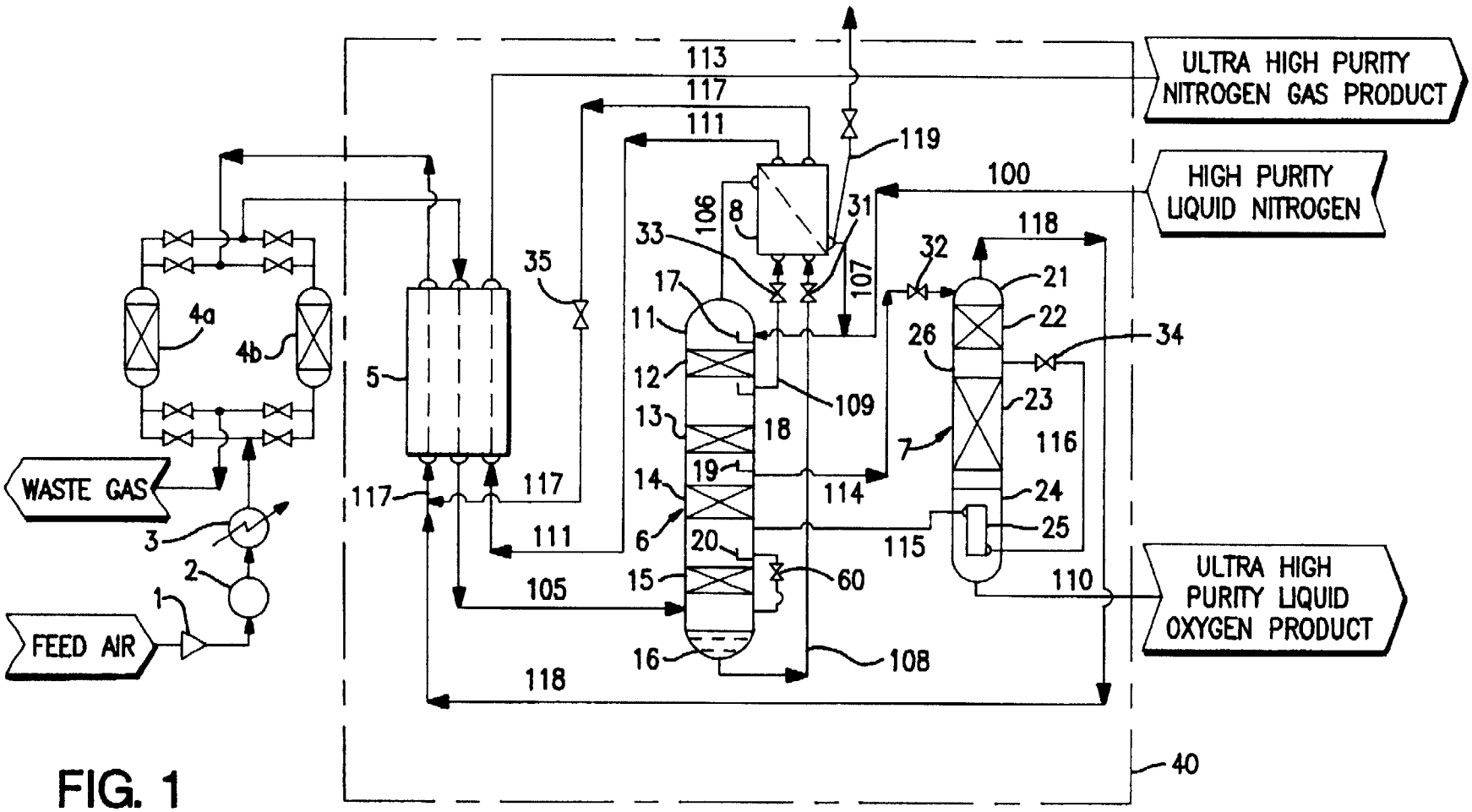
FIG. 1 shows one example of the ultra high purity nitrogen and oxygen generator unit based on the present invention.
Figure 2:
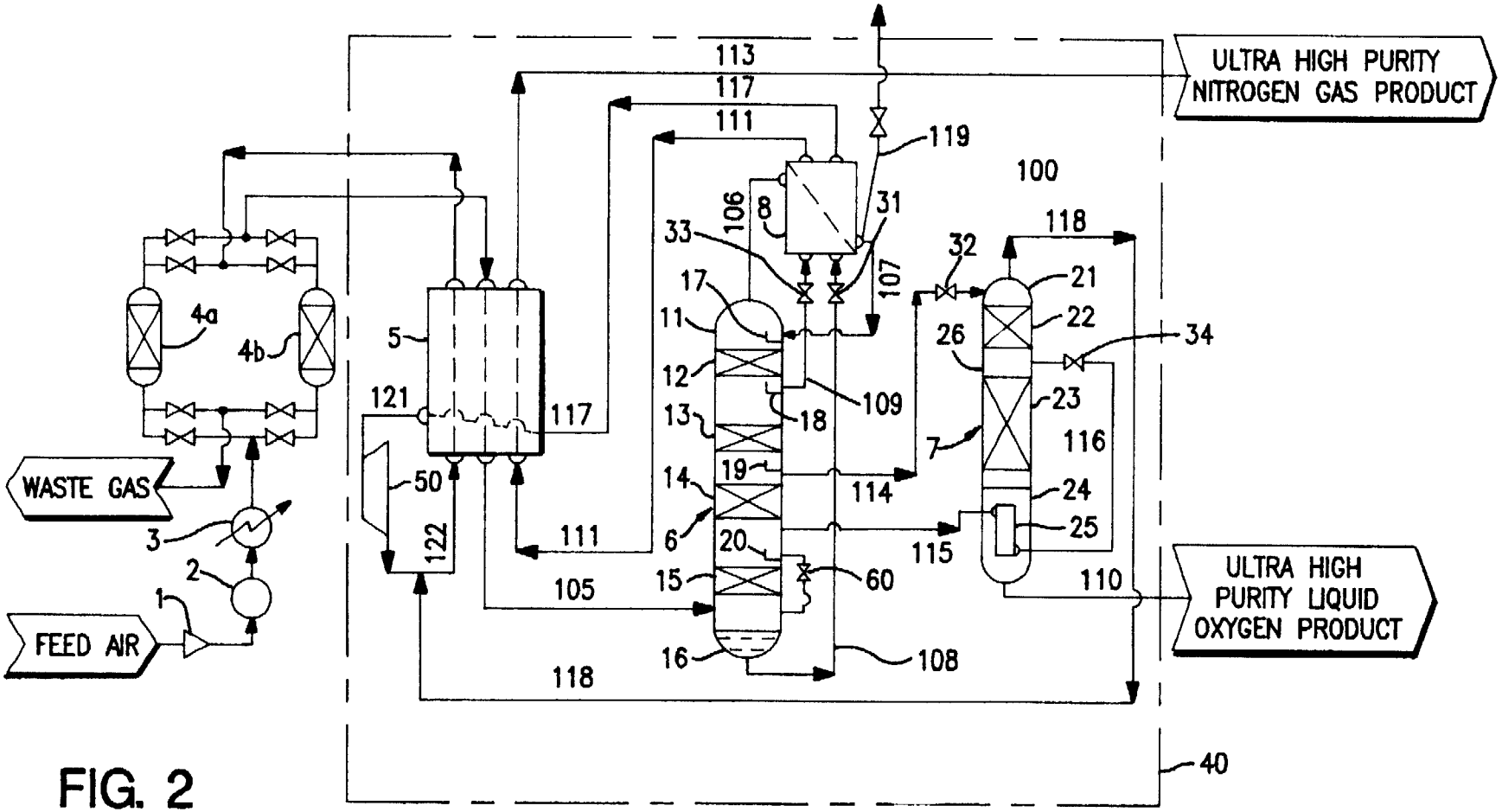
FIG. 2 shows another example of the ultra high purity nitrogen and oxygen generator unit based on the present invention.
Figure 3:
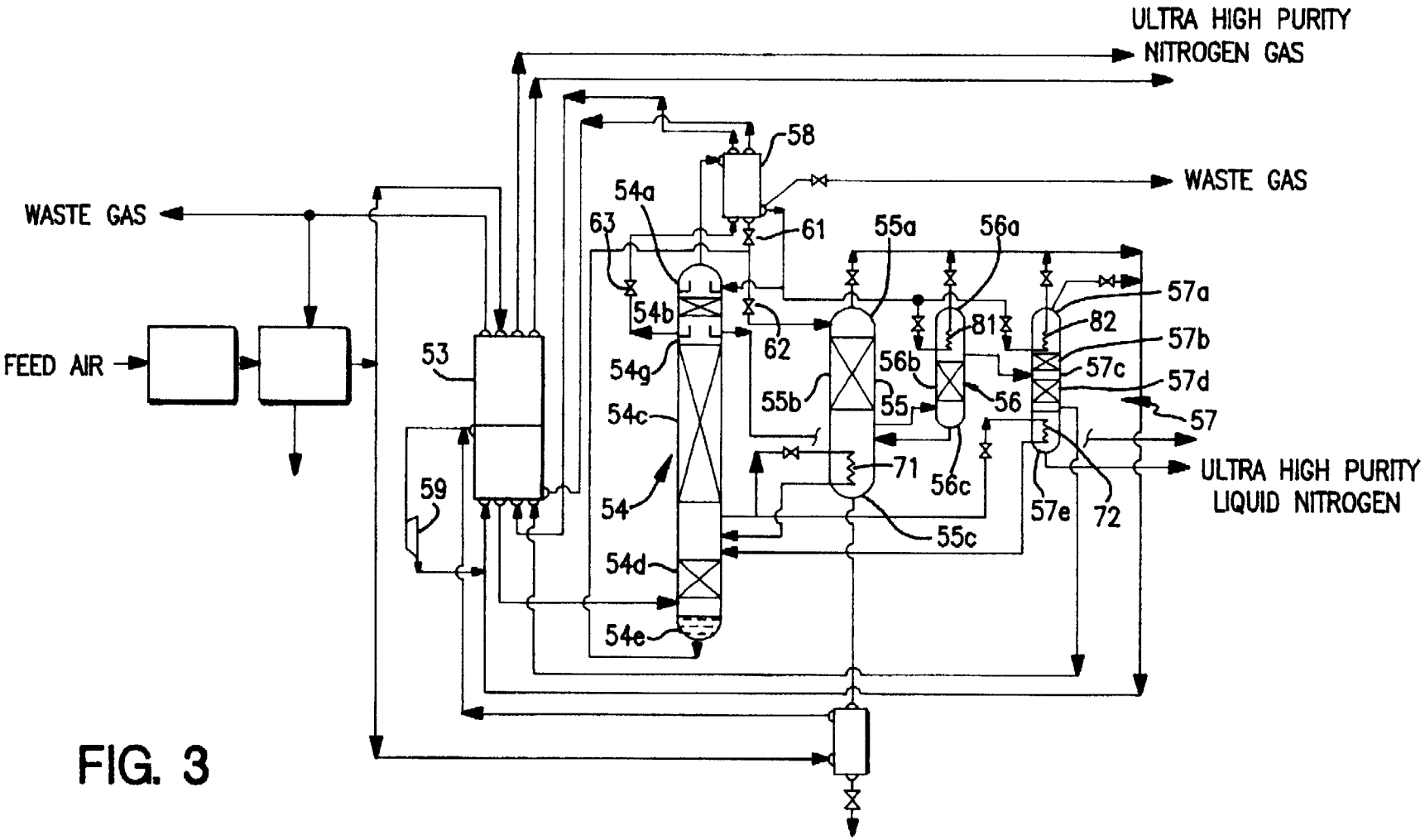
FIG. 3 shows one example of the ultra high purity nitrogen and oxygen generator unit of the prior art.

What is claimed is:

1. An ultra high purity nitrogen and oxygen generator unit, which comprises:

a first rectification column (6) having, in order from above, a first upper space part (11), an upper rectifying part (12), an upper-stage middle rectifying part (13), a lower-stage middle rectifying part (14), a lower rectifying part (15) and a first lower space part (16);

a second rectification column (7) having a second upper space part (21), an upper rectifying part (22), a lower rectifying part (23) and a second lower space part (24);

a main heat exchanger (5) for cooling down air as a feed material through an indirect heat exchange with a refrigerant, and supplying the thus-cooled air to below said lower rectifying part (15);

a high purity liquid nitrogen supply pipe (100) for supplying high purity liquid nitrogen for replenishment of cold (also as a reflux liquid) to above said upper rectifying part (12);

a nitrogen condenser (8) for cooling down high purity nitrogen gas collected in the first upper space part (11), which is introduced therein, and supplying the thus-condensed high purity liquid nitrogen to above the upper rectifying part (12) as a reflux liquid and discharging the non-condensed gas out of the system;

a first expansion valve (31) for reducing the pressure of oxygen-rich liquid air collected in the first lower space part (16), which is introduced therein, and supplying the thus-generated oxygen-rich waste gas to the nitrogen condenser (8) as a refrigerant;

an oxygen-rich waste gas pipe (117) for supplying the oxygen-rich waste gas which has been used as a refrigerant in the nitrogen condenser (8) and then discharged therefrom to said main heat exchanger (5) as a refrigerant;

an ultra high purity nitrogen delivery pipe (109) for recovering a portion of the reflux liquid from between the upper rectifying part (12) and the upper-stage middle rectifying part (13) as ultra high purity liquid nitrogen;

a second expansion valve (32) for reducing the pressure of a portion of the reflux liquid which is introduced therein from between the upper-stage middle rectifying part (13) and the lower-stage middle rectifying part (14), and supplying the thus-generated gas-liquid mixture to above the upper rectifying part (22) of the second rectification column (7);

a reboiler (25) placed in the second lower space part (24) for heating liquid collected in the second lower space part to evaporate a portion thereof;

a pipe (115) for extracting air from between the lower-stage middle rectifying part (14) and the lower rectifying part (15), and supplying the thus-extracted air to the reboiler (25) as a heating source;

a pipe (116) having a fourth expansion valve (34) for supplying air which has been used as the heating source in the reboiler (25) so as to be cooled down and liquefied as itself to above the lower rectifying part (23);

a waste gas pipe (118) for discharging gas collected in the second upper space part (21) out of the system; and an ultra high purity liquid oxygen delivery pipe (110) for recovering liquid collected in the second lower space part (24) as ultra high purity liquid oxygen.

2. An ultra high purity nitrogen and oxygen generator unit, according to claim 1, which comprises further an expansion turbine (50) for reducing the pressure of oxygen-rich waste gas which has been used as the refrigerant in the nitrogen condenser (8) and then discharged therefrom so that its temperature is caused to drop, and supplying the temperature-dropped oxygen-rich waste gas to said main heat exchanger (5) as a refrigerant.

3. An ultra high purity nitrogen and oxygen generator unit, according to claim 2, which comprises further a third expansion valve (33), wherein said ultra high purity liquid nitrogen is introduced into this third expansion valve (33) so as to be reduced in pressure, and the thus-generated ultra high purity nitrogen gas is supplied in turn to said nitrogen condenser (8) and said main heat exchanger (5) as a portion of the refrigerant, and then supplied to the outside of the system as a product.

4. An ultra high purity nitrogen and oxygen generator unit, according to claim 2, which comprises further a flow rate regulation valve (60), wherein a portion of the reflux liquid is directly introduced from between said lower-stage middle rectifying part (14) and said lower rectifying part (15) into said first lower space part (16) through said flow rate regulation valve (60), thereby regulating the amount of the reflux liquid flowing through said lower rectifying part (15).

5. An ultra high purity nitrogen and oxygen generator unit, according to claim 1, which comprises further a third expansion valve (33), wherein said ultra high purity liquid nitrogen is introduced into this third expansion valve (33) so as to be reduced in pressure, and the thus-generated ultra high purity nitrogen gas is supplied in turn to said nitrogen condenser (8) and said main heat exchanger (5) as a portion of the refrigerant, and then supplied to the outside of the system as a product.

6. An ultra high purity nitrogen and oxygen generator unit, according to claim 1, which comprises further a flow rate regulation valve (60), wherein a portion of the reflux liquid is directly introduced from between said lower-stage middle rectifying part (14) and said lower rectifying part (15) into said first lower space part (16) through said flow rate regulation valve (60), thereby regulating the amount of the reflux liquid flowing through said lower rectifying part (15).

7. An ultra high purity nitrogen and oxygen generator unit, according to claim 5, which comprises further a flow rate regulation valve (60), wherein a portion of the reflux liquid is directly introduced from between said lower-stage middle rectifying part (14) and said lower rectifying part (15) into said first lower space part (16) through said flow rate regulation valve (60), thereby regulating the amount of the reflux liquid flowing through said lower rectifying part (15).

* * * * *